US009253556B1

(12) United States Patent
Pounds et al.

(10) Patent No.: US 9,253,556 B1
(45) Date of Patent: Feb. 2, 2016

(54) DISSIPATIVE SYSTEM FOR INCREASING AUDIO ENTROPY THEREBY DIMINISHING AUDITORY PERCEPTION

(71) Applicants: William E. Pounds, Colorado Springs, CO (US); Oliver Benjamin Carson, Colorado Springs, CO (US)

(72) Inventors: William E. Pounds, Colorado Springs, CO (US); Oliver Benjamin Carson, Colorado Springs, CO (US)

(73) Assignee: CONCEALFAB CORPORATION, Colorado Springs, CO (US)

( * ) Notice: Subject to any disclaimer, the term of this patent is extended or adjusted under 35 U.S.C. 154(b) by 0 days.

(21) Appl. No.: 14/473,838

(22) Filed: Aug. 29, 2014

Related U.S. Application Data

(60) Provisional application No. 61/871,779, filed on Aug. 29, 2013.

(51) Int. Cl.
*G10K 11/04* (2006.01)
*H04R 1/02* (2006.01)

(52) U.S. Cl.
CPC ..... *H04R 1/02* (2013.01)

(58) Field of Classification Search
CPC ..... G10K 11/04; G10K 11/16
USPC ..... 181/200
See application file for complete search history.

(56) References Cited

U.S. PATENT DOCUMENTS

| | | | | |
|---|---|---|---|---|
| 1,547,740 | A | 7/1925 | Fessenden | |
| 2,043,416 | A | 6/1936 | Lueg | |
| 2,611,035 | A | 9/1952 | Duncan | |
| 2,972,018 | A | 2/1961 | Hawley et al. | |
| 3,826,870 | A | 7/1974 | Wurm et al. | |
| 3,936,606 | A | 2/1976 | Wanke | |
| 4,473,906 | A | 9/1984 | Warnaka et al. | |
| 4,783,817 | A | 11/1988 | Hamada et al. | |
| 4,805,733 | A | 2/1989 | Kato et al. | |
| 5,347,585 | A | 9/1994 | Taki et al. | |
| 5,673,325 | A | 9/1997 | Andrea et al. | |
| 6,431,310 | B1 * | 8/2002 | Heitmann | 181/200 |
| 7,357,219 | B2 * | 4/2008 | Mafi et al. | 181/202 |
| 7,712,576 | B2 * | 5/2010 | Goto et al. | 181/225 |
| 7,929,295 | B2 * | 4/2011 | Joshi | 361/679.5 |
| 8,146,707 | B2 * | 4/2012 | Choi et al. | 181/225 |
| 8,240,429 | B1 * | 8/2012 | Singhal | 181/224 |
| 2005/0056481 | A1 * | 3/2005 | Mafi et al. | 181/202 |

* cited by examiner

*Primary Examiner* — Forrest M Phillips
(74) *Attorney, Agent, or Firm* — Sheridan Ross P.C.; Stanley J. Gradisar

(57) ABSTRACT

Through construction techniques, geometric design, and materials selection, audio entropy or randomness is introduced within an equipment structure or enclosure. This takes away the available sound energy by absorbing it or making it do work and dissipate before it can project audible sound outside the equipment structure or enclosure. "Damping" of the sound traveling through the equipment structure or enclosure is achieved by applying foam and/or fiberglass board/mat material to surfaces within the equipment structure or enclosure. By employing different material densities in the equipment structure or enclosure, sound levels at different frequencies can be diminished by not allowing them to pass through the structure or by greatly decreasing their amplitude. The semicircular sheathing within the equipment structure or enclosure that forms part of the airflow path refracts sound waves at different angles and does not make a good waveguide for transmitting the sound, which diminishes it.

30 Claims, 7 Drawing Sheets

SECTION A-A

SECTION B-B

SECTION C-C

DISSIPATIVE SYSTEM FOR INCREASING AUDIO ENTROPY THEREBY DIMINISHING AUDITORY PERCEPTION

CROSS-REFERENCES TO RELATED APPLICATIONS

This application claims the benefit of U.S. Provisional Application Ser. No. 61/871,779 filed on Aug. 29, 2013 titled "Dissipative System For Increasing Audio Entropy Thereby Diminishing Auditory Perception" which is incorporated herein by reference in its entirety for all that is taught and disclosed therein.

BACKGROUND

The present invention relates to equipment structures or enclosures that are placed in proximity to humans or animals which can be a noise nuisance due to the emanating sounds of fans or buzzing transformers etc., that are mounted inside. The fans can turn on and off based on heat loading and this sound level change disturbs humans as well as causes dogs to bark due to their extended frequency range of hearing. This can greatly compound the noise nuisance issue. Heretofore this has been a necessary evil because of societal demands for electricity or cell phone service provided by the equipment enclosure or structure that is the source of the noise.

A sound wave is the mechanical movement of energy through a medium. The sound energy causes the medium to oscillate which transfers the energy through the medium, molecule to adjacent molecule. These mechanical waves can only be produced in media which possess elasticity and inertia. Sound waves are similar to the ripples on the surface of water when disturbed by a rock.

The energy entering a mechanical system, such as electricity, powers a fan motor, which spins the fan blades or armature, stimulates the surrounding equipment structure or enclosure through transmitted sound energy or vibration that travels through a medium, such as the air in the exhaust vent path, or the metal that the equipment structure or enclosure is made. This transmitted sound energy transfers to the equipment structure or enclosure as well and can modulate the external air surrounding it and cumulatively transmit audible sound away from the equipment structure or enclosure that can be heard by humans or animals.

Prior approaches to solving this problem have attempted to manipulate sound with a variety of electronic circuits, such as the "Acoustic Abatement Method and Apparatus" described in U.S. Pat. No. 3,936,606 by Ronald L. Wanke. U.S. Pat. No. 2,043,416 by Paul Luer titled "Process of Silencing Sound Oscillations" transforms acoustic oscillations into electrical signals, and then reproduces them on another apparatus suitably spaced from a microphone to reproduce the sound at a different phase which cancels the original sound. None of these electrically active methods diminish the original sound levels as simply and passively as the present method and system described herein.

SUMMARY

This Summary is provided to introduce in a simplified form a selection of concepts that are further described below in the Detailed Description. This Summary is not intended to identify key or essential features of the claimed subject matter, nor is it intended to be used to limit the scope of the claimed subject matter.

The Dissipative System For Increasing Audio Entropy Thereby Diminishing Auditory Perception defined herein employs construction techniques, geometry, material(s) selections, and coatings that create "audio entropy" or randomness in the sound energy being created within these equipment structures or enclosures. This diminishes the available sound energy by absorbing it or making it do work which dissipates it before it can project audible sound to humans or animals.

"Entropy" is the condition in which this sound or vibration energy is disrupted or impeded from traveling along or through the elements of the equipment structure or enclosure, such as ducting for an airflow path, thereby diminishing its auditory signature perceived by humans or animals. Entropy techniques can include "damping" of the sound traveling through the equipment structure or enclosure by applying sound absorbing material(s) or coatings to surfaces within the sometimes extremely limited space within an equipment structure or enclosure, and in the path of the air being exhausted from the equipment structure or enclosure, while still providing enough free space to allow for proper ventilation in-and-out of the equipment structure or enclosure. Forcing the airflow path to turn different directions aids in diminishing the sound's amplitude because sound does not turn as easily as air and gets absorbed in the sound absorbing materials that make up or line the airflow path.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together. When each one of A, B, and C in the above expressions refers to an element, such as X, Y, and Z, or class of elements, such as X1-Xm, Y1-Yn, and Z1-Zo, the phrase is intended to refer to a single element selected from X, Y, and Z, a combination of elements selected from the same class (e.g., X1 and X2) as well as a combination of elements selected from two or more classes (e.g., Y1 and Z3).

It is to be noted that the term "a entity" or "an entity" refers to one or more of that entity. As such, the terms "a" (or "an"), "one or more," and "at least one" can be used interchangeably herein. It is also to be noted that the terms "comprising," "including," and "having" can be used interchangeably.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

"Fiberglass board/mat material" means medium-high density (three to six pounds per square foot) fiberglass board approximately two to four inches thick that is cut down to the size and shape required for a particular application. The fiberglass board/mat material is readily available from various manufacturers including Owens Corning and Johns Manville.

"Foam" means any material that has been made porous (or spongelike) by the incorporation of gas bubbles. Foam can be obtained in sheets and rolls of various thicknesses.

"Neoprene" means any of a class of elastomers (rubberlike synthetic organic compounds of high molecular weight) made by polymerization of the monomer 2-chloro-1,3-butadiene and vulcanized (cross-linked, like rubber), by sulfur, metallic oxides, or other agents. Neoprene can be obtained in sheets and rolls of various thicknesses.

Figure 1:
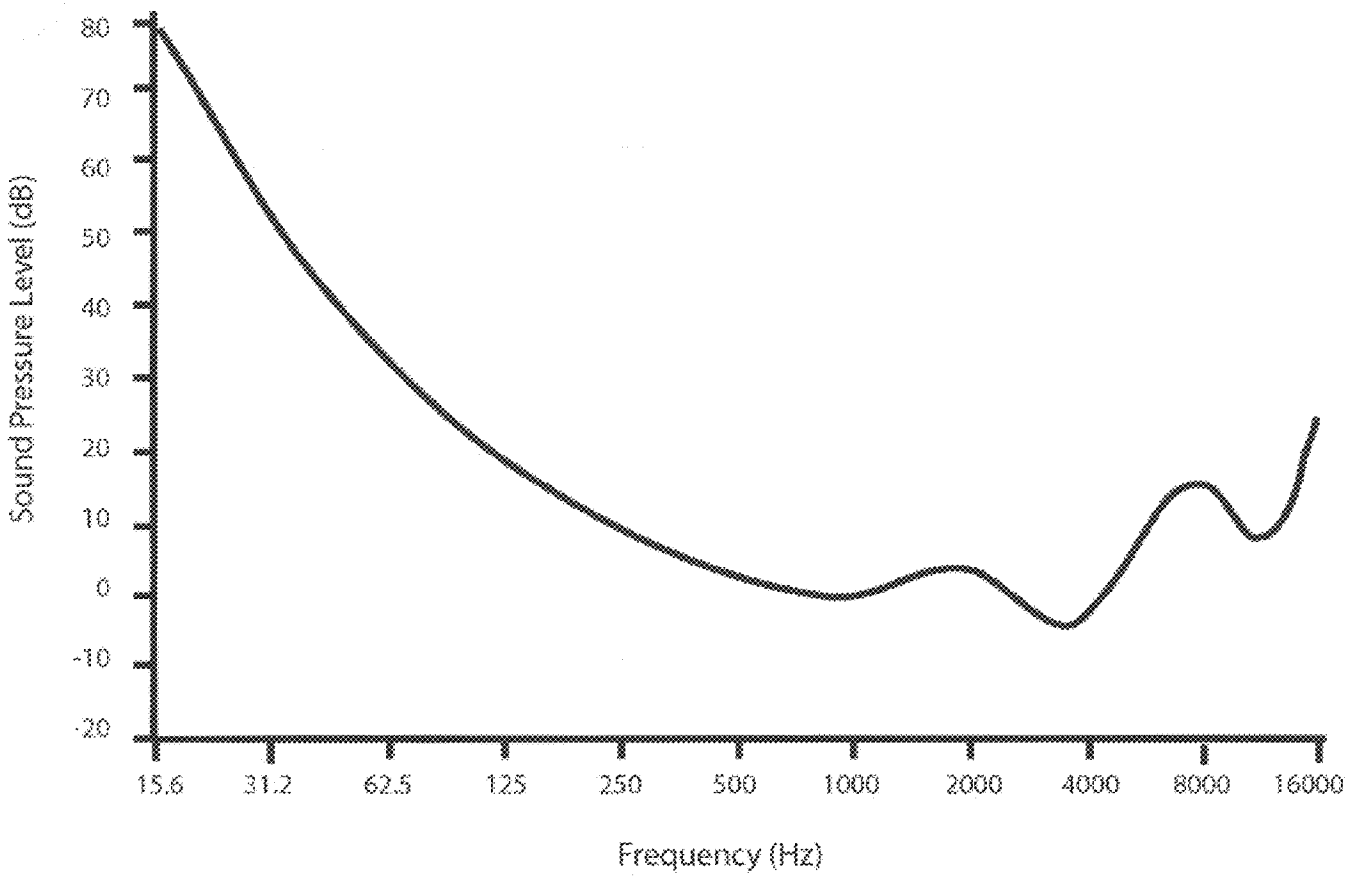
FIG. 1 shows a chart depicting the relationship of sound pressure level in decibels and frequency in Hertz for perceived human hearing.

To assist in the understanding of the present disclosure the following list of components and associated numbering found in the drawings is provided herein:

Table of Components

| Component | # |
|---|---|
| structure | 200 |
| base section | 202 |
| equipment sections | 204 |
| battery backup section | 206 |
| skirt section | 208 |
| antenna section | 210 |
| diplexer section | 212 |
| diameter | 214 |
| door | 302 |
| fans | 304 |
| electronic component | 306 |
| vents | 308 |
| door lining | 310 |
| equipment section | 400 |
| outer skin | 402 |
| top plate | 404 |
| bottom plate | 406 |
| door support frame | 407 |
| vents | 408 |
| rear airflow path lining | 410 |
| end caps | 412 |
| airflow separator | 414 |
| mounting plate | 416 |
| top holding assembly | 418 |
| fasteners | 419 |
| electronic component | 420 |
| structural members/wireways | 422 |
| airflow wireway lining | 424 |
| filler block | 426 |
| front airflow path lining | 428 |
| door | 430 |
| end caps | 432 |
| airflow separator | 434 |
| door lining | 436 |
| equipment section | 500 |
| outer skin | 502 |
| fans | 504 |
| electronic component | 506 |
| vents | 508 |
| opening | 510 |
| upper airflow path | 512 |

-continued

Table of Components

| Component | # |
|---|---|
| lower airflow path | 514 |
| fiberglass board/mat material | 516 |
| inlet ducts | 518 |
| outlet ducts | 520 |
| wireways | 522 |
| cables | 524 |
| connectors | 526 |
| grounding stud | 528 |
| door | 530 |
| fasteners | 532 |
| safety chain | 534 |

DETAILED DESCRIPTION

The inventors have discovered that fiberglass board/mat material of the correct mechanical proportions have natural sound abating and/or damping qualities due to the material's related density and/or softness. By employing different material thicknesses and/or coatings in an equipment structure or enclosure, the sound levels at different desired frequencies can thereby be diminished by not allowing them to pass all the way through, or greatly decrease their amplitude. They can also absorb radiated energy in a gas flow like the airflow path required for one or more fans.

Acoustic waves are longitudinal waves that propagate by means of adiabatic compression and decompression (i.e., they do work without producing heat).

The fiberglass board/mat material employed can also cause these sound waves to compress, which creates a minute amount of heat energy loss which is easily distributed throughout the equipment structure or enclosure without issue. This energy is no longer available to stimulate the system and the system's audio perception is reduced to a desired and more tolerable level. This is a distinctly non-adiabatic process.

Air from the fan and its sound energy does not pass unrestricted through the equipment structure or enclosure, but through the airflow path duct formed by the fiberglass board/mat material employed within the equipment structure or enclosure. Air takes the path of least resistance and some of the sound is carried with it. The geometry of this airflow path duct is part of the entropy system described herein reduces the perceived sound by reflecting it or impinging it onto as many surfaces as possible to strip away the sound's energy.

The fiberglass board/mat material employed allows the audible sound to pass only partially through the equipment structure or enclosure, or allows the audible sound to pass all the way through the equipment structure or enclosure while diminishing it due to the fiberglass board/mat material's natural sound absorbing qualities. The sound waves "hit" the metal outer sheathing of the equipment structure or enclosure and stimulate it, using up some part of their energy, and causing loss due to its large mass. If the amplitude of the sound wave, which is the difference between its minimum and maximum value, can be reduced, it will have less energy available to stimulate the air (medium) between the equipment structure or enclosure and the external human or animal, and becomes less offensive. In other words, it diminishes the air pressure in the wave.

Figure 6:
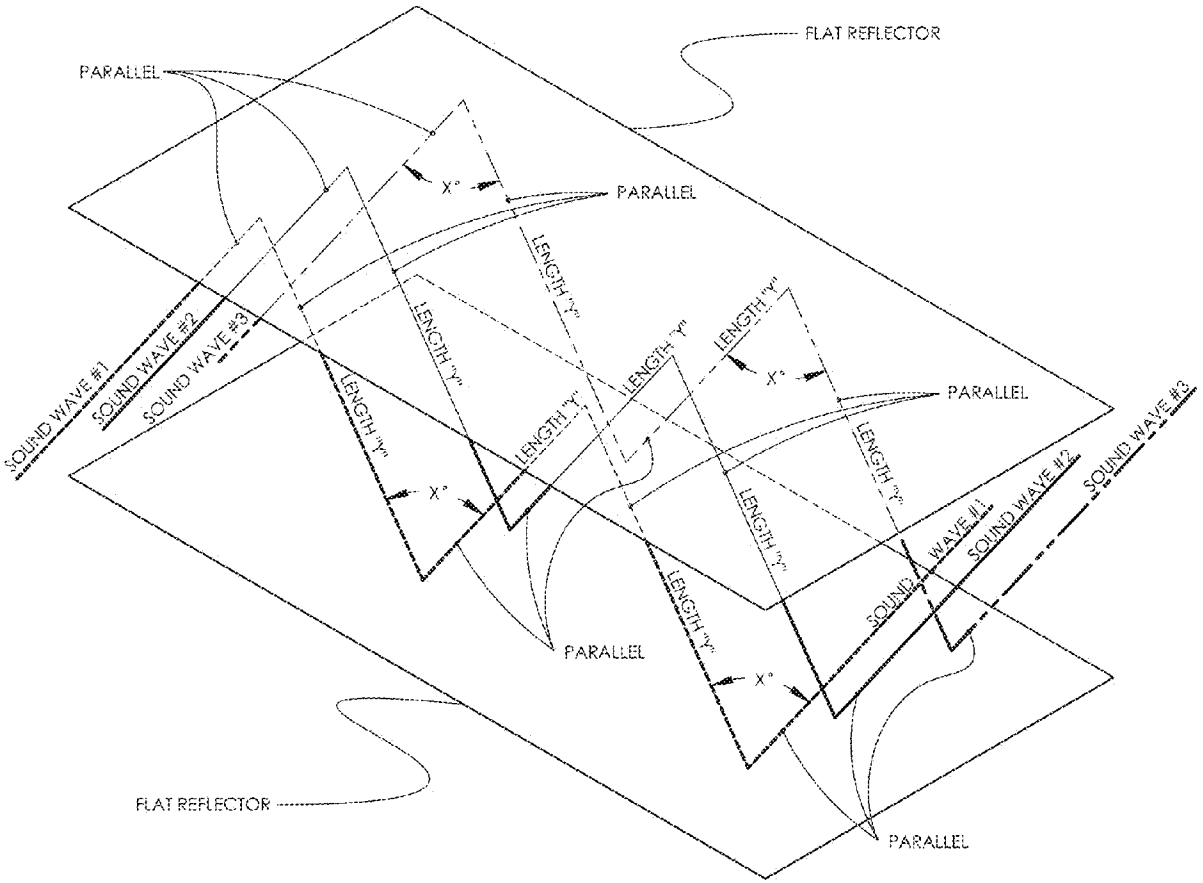
FIG. 6 shows a perspective view of how sound waves reflect off of two parallel flat surfaces.

A sound pressure wave reflects or bounces off of a surface at the same angle that it hits the surface in one plane (see FIG. 6). It also bounces off at a skewed angle with respect to curved surfaces if employed in the equipment structure or enclosure in the other "polarization" (see FIGS. 7A-7D). This further "divides" the energy because the length to the next reflective surface is different. It then allows all frequencies to pass down the airflow path out of phase, thereby dividing them.

If a semicircular sheathing is used to create the airflow path duct, it refracts sound waves at different angles and does not make a good waveguide for transmitting the sound wave, and will diminish the sound wave. Some of the sound waves pass through the outer damping material to the metal sheathing of the equipment structure or enclosure and bounce back again to the opposite wall of the metal sheathing where the sound wave encounters yet another layer of sound absorbing material, further diminishing its energy and its amplitude.

Since multi-frequency sound attenuation is realized by different absorptive density properties or mechanical size(s) of the various layers, and elements behaving differently due to the various frequencies interacting with them, there is a natural hysteresis set in motion due to past stimulation which further creates sound entropy.

The pressure reducing effects of the fiberglass board/mat material creates turbulence which reduces whistling at the vent holes in the equipment structure or enclosure by creating random air exit paths and directions.

Multiple air directional changes are employed because the air exits the noise generating fan orthogonally (0 degrees) to the main direction of the vent holes in the sheathing.

The system may also employ additional plates, tabs, tangs, helixes, or baffles to redirect or trap sound while allowing maximum airflow.

One embodiment of an equipment structure or enclosure is a monopole, which is in essence a hollow tube like a chime designed to conceal an antenna, transformer, or other electrical component. The fiberglass board/mat material glued to the interior does not allow the structure to reach a frequency or harmonic of a frequency that is offensive to the hearer.

The placement, pattern, and size of the intake vent holes and exhaust vent holes employ techniques to create a shift in the frequency of the produced sound that are of a less offensive frequency due to only non-audible frequencies being allowed to escape by changing the static pressure of the fans and reduce "whistling" caused by turbulence around each intake or exhaust opening.

The fiberglass board/mat material causes "refraction" which changes phase velocity but leaves frequency the same. Frequency shifting can also be accomplished by tightly gluing textured neoprene or other materials to the airflow path duct walls, which changes the wall's "surface phenomenon" and creates more resistance to sound at certain frequencies than others. The resistive and reactive properties of an acoustic medium form an acoustic impedance in conjunction with the fiberglass board/mat material.

In one embodiment, the sheathing has predetermined diameter vent holes, and it is a resistive element and/or filter because it does not allow all frequencies to pass through equally. A perforated sheet, or sheets, can also be placed within the airflow path duct to redirect the sound wave as well as hold foam materials and position them in the airflow path duct.

Sound absorbing fiberglass board/mat material(s) at the end of the airflow path duct prevent reflection of specific harmonics (waves out of phase) are designed to absorb lower frequencies having longer wavelengths that can travel down the long airflow path duct center-line.

Thin fixed vanes in the airflow path duct of different lengths that redirect and/or change the reflected airflow path spaced at unequal distances to attenuate different audio frequencies can also be employed to further diminish the sound energy.

Foam strips or fiberglass board/mat material arranged horizontally around the periphery of the structure are staggered in height to refract waves by creating "orthogonal steps" in the airflow path to redirect or bounce the air around as many times as possible before allowing it to exit the equipment structure or enclosure. Their surfaces can also form reversed inclined planes to redirect the sound rearwards or have the effect of a reverse megaphone.

Because of the difference in length from the fans to the exhaust holes, the optimal frequencies emitted must be polyphonic, and are, by definition, diminished or spread-out.

By directing the sound out of two distinct exit vents, the "focus" of the sound is divided, thereby lessening the effect in one specific location. It also doubles the available airflow path volume in the same diameter enclosure, like a tee, thereby enhancing its thermal efficiency.

Since sound waves bounce off of flat walls at the same angle at which they strike (see FIG. 6), the design creates "corners" and a curved shaped airflow path to increase the distance traveled by the sound waves, allowing them to dissipate by dispersion (see FIGS. 7A-7D). The greater airflow path length also includes increased incidences of reflection off of the airflow path duct walls. This has a corresponding reduction in sound energy at each contact.

The fraction of the sound absorbed is governed by the acoustic impedance of the foam/media and is a function of frequency and incidence angle and the over-all impingement area. This system takes these factors into account and maximizes the effectiveness of these sound absorbing qualities with sizes of fiberglass board/mat material that work best at the frequencies that are desired to be diminished.

The longitudinal voids of the equipment structure or enclosure can be filled with two part, expanding foam, such as Instapak Quick™ Packaging Foam available from LPS Industries, to help prevent the reactive elements of the system from being stimulated into achieving structure resonances that create sound or can add damping to the system which moves the resonant frequency away from the excitation frequency of the equipment structure or enclosure.

Referring now to the Figures, like reference numerals and names refer to structurally and/or functionally similar elements thereof, and if objects depicted in the figures that are covered by another object, as well as the tag line for the element number thereto, may be shown in dashed lines. FIG. 1 shows a chart depicting the relationship of sound pressure level in decibels and frequency in Hertz for perceived human hearing. Referring now to FIG. 1, sound travels at 1,130 feet-per-second in air. The speed of sound divided by its frequency equals the length of the wave. Since numerous methods of sound attenuation are employed at once, the system covers the range of audible sound (as shown in FIG. 1) being emitted from the structure at a wide range of operating temperatures. The speed which sound travels in air changes with the temperature. Because a variety of sound suppression technologies are employed, the effect of temperature changes on sound attenuation in the system is minimal. In FIG. 1, the chart depicts the relationship of sound pressure level in decibels and frequency in Hertz for perceived human hearing. The scale for the sound pressure level is logarithmic and is used to set the legal limits of sound that can emanate from an equipment structure or enclosure except it is "A" weighted to more closely align with how humans hear. The unit becomes dBA. In other words the hysteresis or variables, such as temperature, of the system do not drastically affect the performance of the system. In general, the speed of sound is proportional to the square root of the ratio of the elastic modulus (stiffness) of the medium and its density. Foam strips or fiberglass board/mat material exhibit flexibility over a wide range of temperatures to prevent a large change in the operation of the system over a wide temperature range.

There is a (variable) hysteresis in the structure system due to temperature variance causes:

- Viscosity/hardness of the fiberglass board/mat material changes with temperature which effects its rarefaction—each part of the sound wave travels at the local speed of sound in the local medium;
- Fans run harder when the electrical component is hotter because overall workload directed toward the electrical component makes it work harder;
- The speed of sound changes with the temperature of the medium (air as well as metal);
- The speed of sound changes with the amount of moisture in the air; and
- The speed of sound changes with the temperature of the air.

The foam strips or fiberglass board/mat material lining the walls of the airflow path duct not only have staggered heights but can also have inter-leaved densities that create resistance for the sound to travel from one to the next.

Rarefaction occurs when a speaker moves backward—sort of creating a sound vacuum. This happens with the foam strips or fiberglass board/mat material's surface as well. As the foam strips or fiberglass board/mat material moves minutely in one direction or the other, it has a different effect on the sound waves that it interacts with.

Resonant frequencies are multiples of length modes x, y, and z axis. In other words a 2'×3' vent resonates at multiples of 2, i.e., 2, 4, 6, 8 etc., and also at multiples of 3, i.e., 3, 6, 9, 12, etc. The length and shape of the airflow path duct in the structure is fixed to be the worst harmonic possible, thereby impeding the sound energy and not allowing it to achieve resonance at unwanted frequencies.

The tangential modes are reflections for the lengths between the middle of the walls of the airflow path or space. When viewed from the top this would look like sound bouncing from the midpoint of each wall like a diamond. The length and shape of the airflow path duct in the structure can be specified to be the worst harmonic possible thereby impeding the sound energy.

Figure 2:
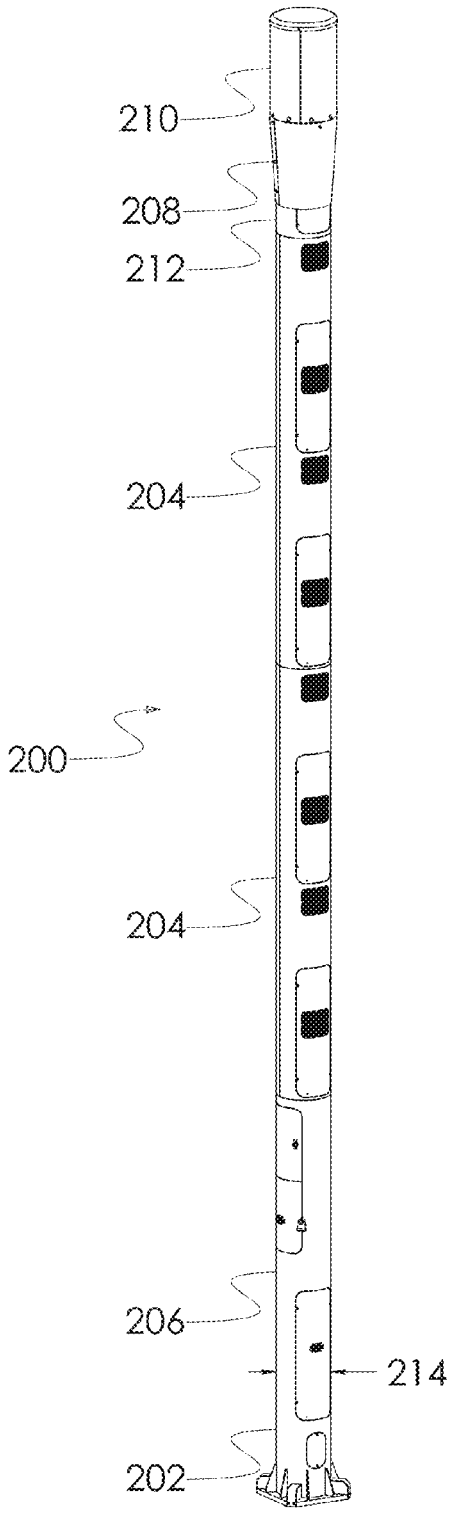
FIG. 2 shows an elevation view of a representative equipment structure or enclosure in an embodiment of the present invention.

FIG. 2 shows an elevation view of a representative equipment structure or enclosure in an embodiment of the present invention. Referring now to FIG. 2, structure 200, also referred to as a monopole, has a base section 202 that can be secured to a foundation. A battery backup section 206 houses a rectifier, controller, and batteries. One or more equipment sections 204 house electronic equipment within the structure 200. In this embodiment, the wires leading to an antenna section 210 are enclosed within skirt section 208 right above diplexer section 212. In some applications, an extension section (not shown) can extend the height of the structure 200 to get the antenna section 210 at the proper elevation. Structure 200 has a diameter 214 that can be of various sizes to accommodate various sized pieces of electronic equipment.

Figure 3:
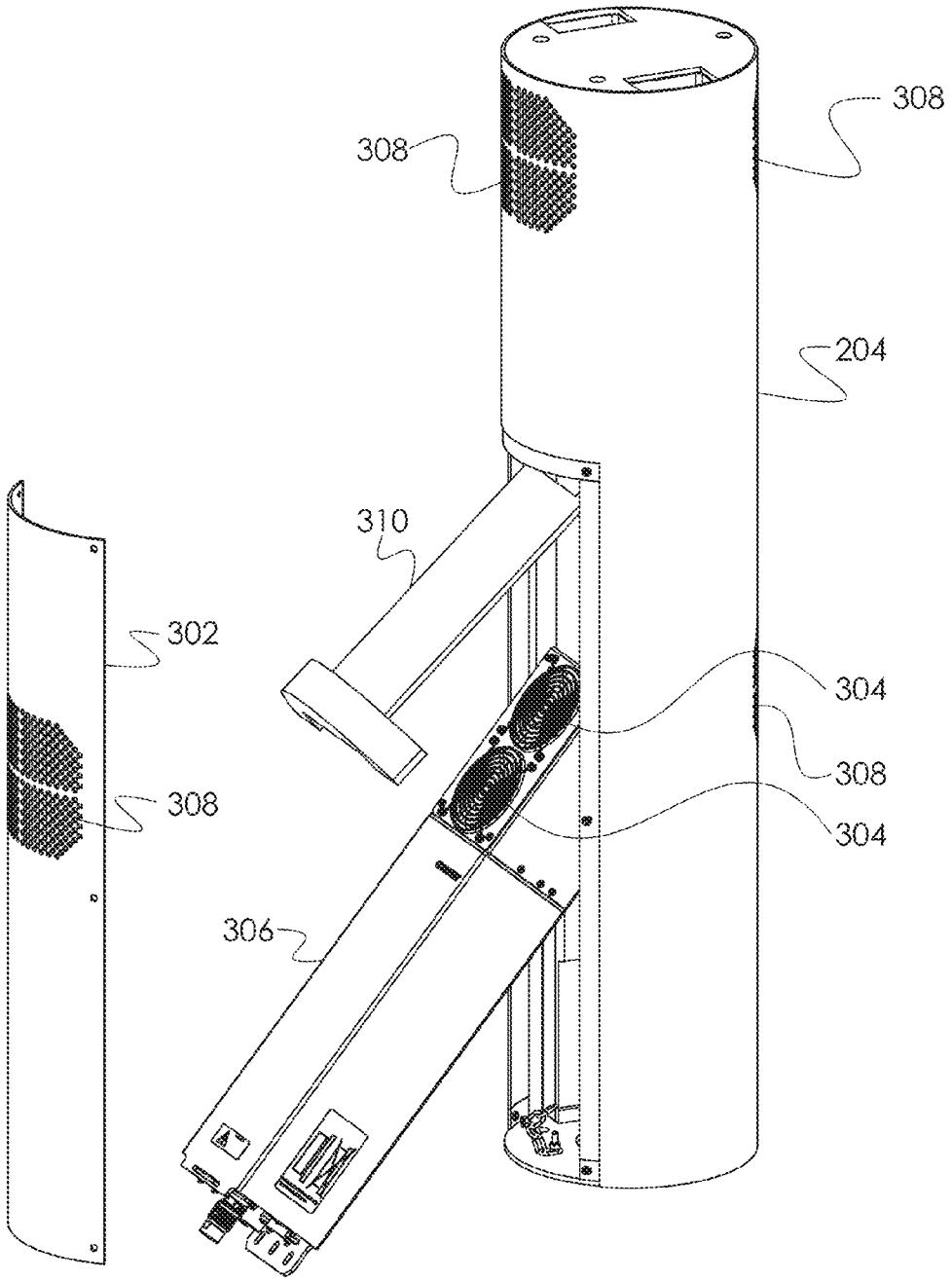
FIG. 3 shows one portion of an equipment section of the structure of FIG. 2 in an embodiment of the present invention.

FIG. 3 shows one portion of an equipment section of the structure of FIG. 2 in an embodiment of the present invention. Referring now to FIG. 3, one portion of equipment section 204 is shown with access hatch or door 302 removed. Each equipment section 204 may have one or more of the sections shown in FIG. 3, as is shown in FIG. 2. Door lining 310 is rotated out of the way to allow the electronic component 306 to be slid into the interior of equipment section 204 and secured tightly with fasteners (see FIG. 4). Electronic component may be an intelligent optical network (ION) radio-over-fiber unit, transformer, or any other type of electrical component that emits sound waves or vibrations that need to be attenuated. Electronic component 306 typically has one or more fans 304 that turn on when the outside air temperature in conjunction with the heat generated by the electronic component 306 rises to a predetermined level, typically controlled by a thermostat. The fans 304 cool down electronic component 306. The vents 308 comprise a screen mesh or a plurality of holes drilled into door 302 and into equipment section 204. Another pair of vents 308 are located on the opposite side of equipment section 204 (partially visible in this view). Alternatively, vents may be a wire mesh filling in a cut-out in door 302 and/or equipment section 204. By changing the size of the holes in vents 308 to an optimum size for the frequency of the sound being generated by electronic component 306 and the speed and quantity of air being moved by the fans 304, the sound wave's amplitude can also be reduced by not allowing the air to whistle, and to create turbulence which breaks up the sound as it passes in or out of the vents 308 of door and equipment section 204.

Sound pressure level measurements of an electric component, such as electronic component 306, freestanding and within equipment section 204, has shown a reduction in sound pressure levels one meter away from between 2.5 to 10.5 db as measured in the front, back, and side of the electronic component.

Figure 4:
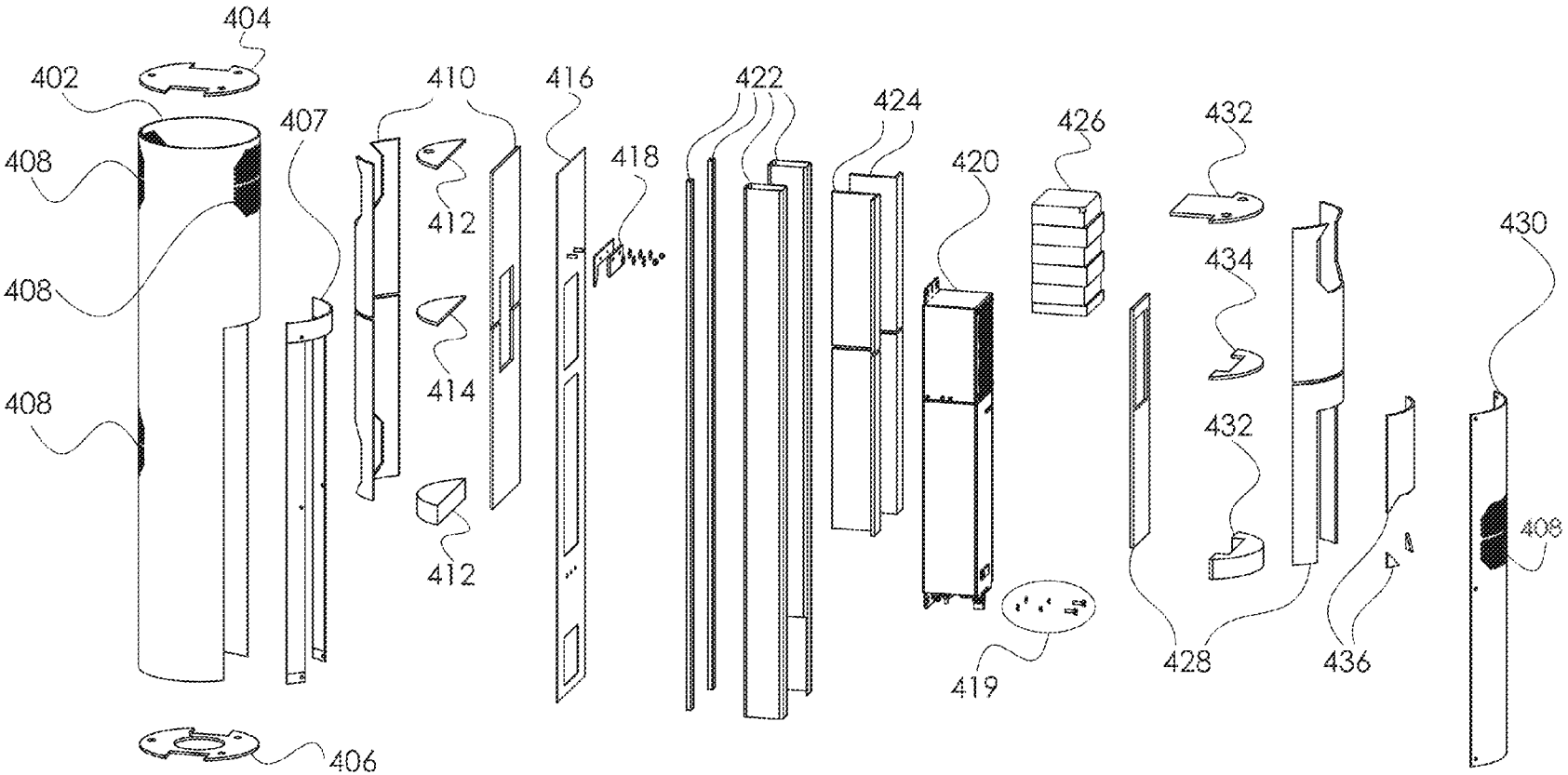
FIG. 4 shows an exploded view of an equipment section of a representative equipment structure or enclosure in an embodiment of the present invention.

FIG. 4 shows an exploded view of an equipment section of a representative equipment structure or enclosure in an embodiment of the present invention. Referring now to FIG. 4, equipment section 400 has an outer skin 402, top plate 404, and bottom plate 406. Vents 408 are located in outer skin 402 and on opposite sides of each other. Door support frame 407 attaches to outer skin 402. Rear airflow path lining 410 has two sections, a curved section that matches the inside curvature of the outer skin 402, and an internal straight section separated by end caps 412 on the top and bottom and in the middle by airflow separator 414. These items are the fiberglass board/mat material described above. Mounting plate 416 has top holding assembly 418 that receives the top portion of the electronic component 420. Fasteners 419 and top holding assembly 418 mechanically attach electronic component 420 to mounting plate 416 to prohibit any vibration(s) that could cause noise. Structural members/wireways 422 provide internal structural support and provide passageways for the cables and connectors necessary. Airflow wireway linings 424 and filler block 426 are also the fiberglass board/mat material described above. Front airflow path lining 428 has two sections, a curved section that matches the inside curvature of the outer skin 402 and door 430, and an internal straight section separated by end caps 432 on the top and bottom and in the middle by airflow separator 434. Door lining 436 is also the fiberglass board/mat material described above. Another vent 408 is located in door 430.

Figure 5A:
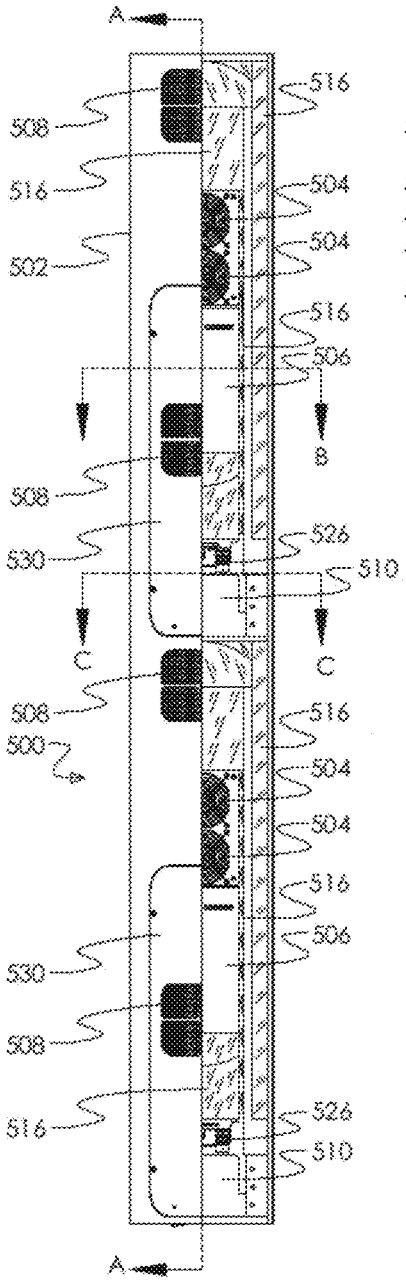
FIGS. 5A-5D show partial cross-section and cut-away views of an equipment section of a representative equipment structure or enclosure in an embodiment of the present invention.

FIGS. 5A-5D show partial cross-section and cut-away views of an equipment section of a representative equipment structure or enclosure in an embodiment of the present invention. Referring now to FIG. 5A, the front side of equipment section 500 is shown in elevation in a partial cross-section and cut-away view. Front vents 508 are located in the outer skin 502 of equipment section 500 and door 530 above and below the location of fans 504 of electronic component 506. In this embodiment, and other embodiments, fans 504 can each generate up to 65 dBA noise level, a level that is too high for deploying in most locales in populated areas. Opening 510 provides access to the wireways 522. Fiberglass board/mat material 516 can be seen in various locations in this view.

Figure 5B:
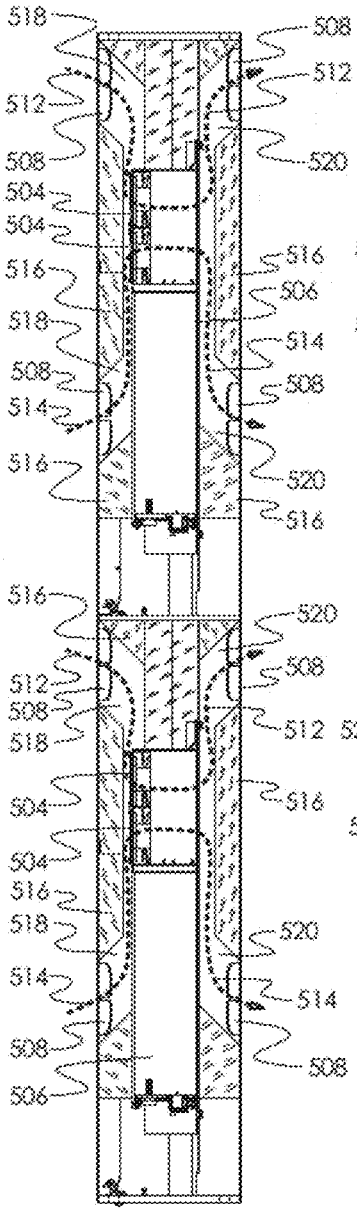

Referring now to FIG. 5B, equipment section 500 is shown in elevation in a partial cross-section and cut-away view taken along line A-A in FIG. 5A. Top fan 504 draws air into into top front vent 508, through upper inlet duct 518, and expels air through upper outlet duct 520 and out of top back vent 508 along upper airflow path 512 within equipment section 500. Similarly, bottom fan 504 draws air into into bottom front vent 508, through lower inlet duct 518, and expels air through lower outlet duct 520 and out of bottom back vent 508 along lower airflow path 514 within equipment section 500. Upper airflow path 512 and lower airflow path 514 are thus bounded by structural members of equipment section 500 and fiberglass board/mat material 516 which effectively reduce the amplitude of the sound produced by the electronic component 506 to allowable or preferred levels. Fiberglass board/mat material 516 can be seen in various locations in this view.

Figure 5C:
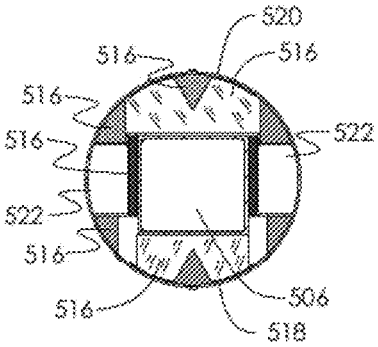

Referring now to FIG. 5C, equipment section 500 is shown in a cross-section view taken along line B-B in FIG. 5A. Wireways 522 are located on either side of electronic component 506. Inlet duct 518 and outlet duct 520 are shown along with fiberglass board/mat material 516.

Figure 5D:
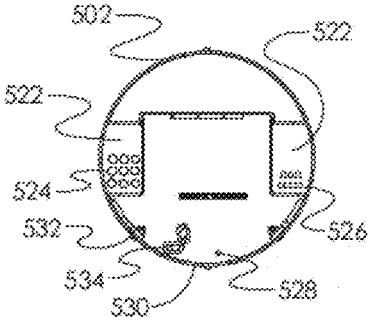

Referring now to FIG. 5D, equipment section 500 is shown in a cross-section view taken along line C-C in FIG. 5A. Wireways 522 can carry a plurality of cables 524 and connectors depending upon the application and need. Grounding stud 528 is provided for making a ground connection. Fasteners 532 can be removed to allow door 530 to be moved out of the way in order to gain access to the interior of equipment section 500. Safety chain 534 is attached to the lower edge of door 530 and attached to the interior of equipment section 500 so that when door 530 is removed, it cannot be dropped to the ground, but can hang down out of the way while accessing the interior of equipment section 500. Safety chain 534 is typically covered with a rubber shrink tubing (not shown) to dampen noise that safety chain 534 would otherwise cause, metal-on-metal. Fasteners 532 when tightened prohibit any vibration(s) between the door 530 and outer skin 502 that could cause noise.

FIG. 6 shows a perspective view of how sound waves reflect off of two parallel flat surfaces. Referring now to FIG. 6, three sound waves, represented by lines #1, #2, and #3, have the same length Y as they reflect from surface-to-surface, and have the same angle of reflection X° from surface-to-surface.

Figure 7A:
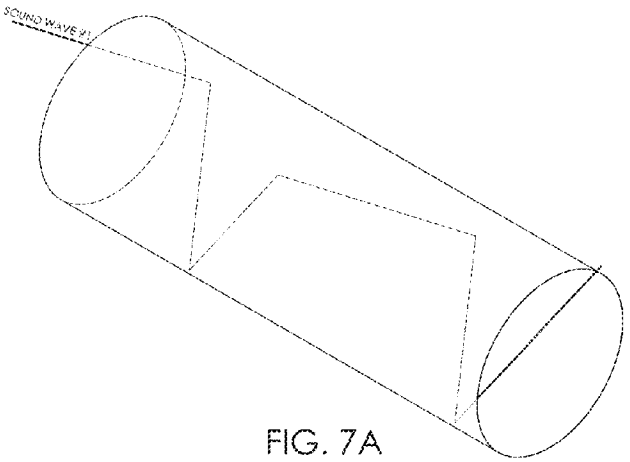
FIGS. 7A-7D show a perspective view of how sound waves reflect off of curved surfaces.
Figure 7C:
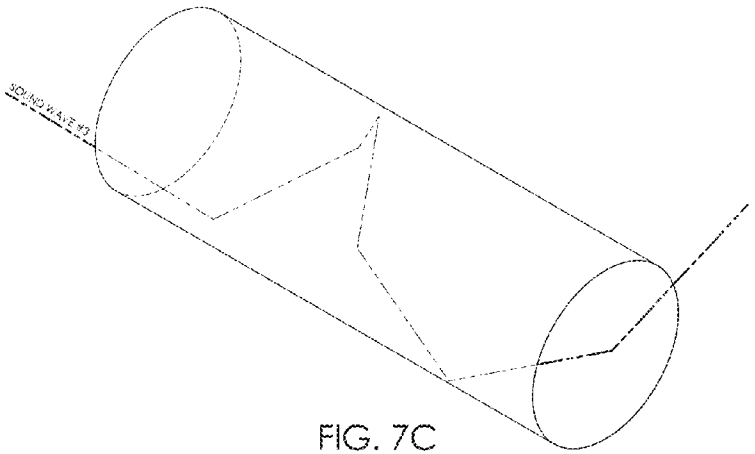
Figure 7D:
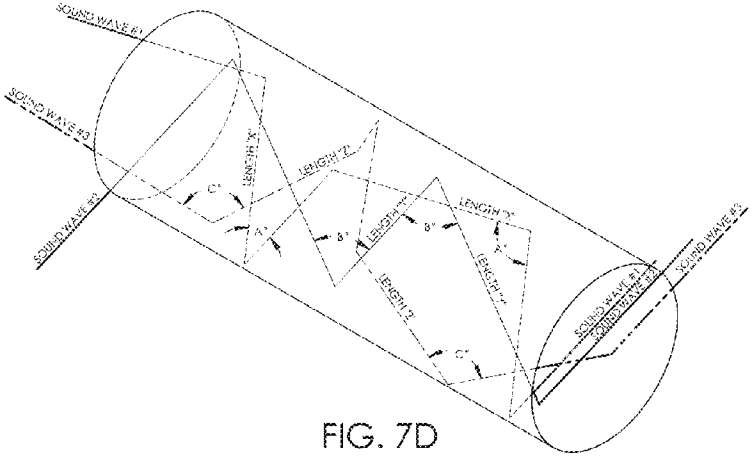
Figure 7B:
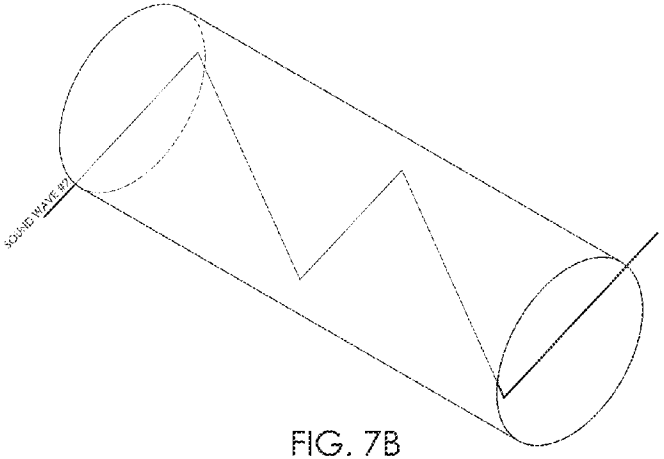

FIGS. 7A-7D show a perspective view of how sound waves reflect off of curved surfaces. Referring now to FIGS. 7A, 7B, and 7C show three sound waves, represented by lines #1, #2, and #3, have different lengths as they reflect from surface-to-surface, and have different angles of reflection from surface-to-surface within the curved structure. The different lengths translate to different frequencies, and the randomness of the lengths and frequencies causes entropy. Curved surfaces have a "lens" effect on the sound waves, causing them to converge, as they travel down the interior of the curved structure as shown in FIG. 7D.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It will be understood by those skilled in the art that many changes in construction and widely differing embodiments and applications will suggest themselves without departing from the scope of the disclosed subject matter.

What is claimed is:

1. A method for increasing audio entropy within a structure or enclosure to diminish auditory perception outside the structure or enclosure, the method comprising:

(a) securing a plurality of sound abating materials within the structure or enclosure;

(b) securing a plurality of features within the structure or enclosure to redirect or trap sound waves;

(c) designing two separate airflow paths within the structure or enclosure that bounce the sound waves off the plurality of sound abating materials and the plurality of features;

(d) designing the two separate airflow paths within the structure or enclosure to each have at least one air directional change; and (e) designing the placement, pattern, and size of a plurality of intake and exhaust vent holes or openings to create a shift in frequency of the sound waves to a non-audible or less offensive frequencies.

2. The method according to claim 1 wherein step (a) further comprises the step of:

securing a one of the plurality of sound abating materials at each end of the two separate airflow paths within the structure or enclosure to prevent reflection of specific harmonics.

3. The method according to claim 1 wherein step (a) further comprises the step of:

securing at least one of a fiberglass board/mat material, a foam, and a textured neoprene to a duct walls of the two separate airflow paths within the structure or enclosure.

4. The method according to claim 1 wherein step (a) further comprises the step of:

determining a size and thickness of the plurality of sound abating materials based upon the frequencies that are desired to be diminished.

5. The method according to claim 1 wherein step (a) further comprises the step of:

arranging the at least a one of the plurality of sound abating materials horizontally within the structure or enclosure staggered in height to refract waves by creating orthogonal steps.

6. The method according to claim 5 further comprising the step of:

forming a surfaces of the plurality of sound abating materials horizontally within the structure or enclosure which vary in height and are shaped like reversed inclined planes to redirect the sound waves rearwards.

7. The method according to claim 5 further comprising the step of:

inter-leaving the plurality of sound abating materials horizontally within the structure or enclosure which vary in height and with different densities to create a resistance for the sound waves to travel through.

8. The method according to claim 1 wherein step (b) further comprises the step of:

securing the plurality of features, selected from the group consisting of a plate, a tab, a tang, a helix, and a baffle, within the structure or enclosure to redirect or trap the sound waves.

9. The method according to claim 1 wherein step (b) further comprises the step of:

securing a plurality of vanes in the two separate airflow paths of different lengths and spaced at unequal distances to attenuate different audio frequencies/sound wavelengths.

10. The method according to claim 1 wherein step (b) further comprises the step of:

securing at least one perforated sheet within each of the two separate airflow paths to redirect the sound waves as well as hold the plurality of sound abating materials in position within the two separate airflow paths.

11. The method according to claim 1 wherein step (d) further comprises the step of:

designing the two separate airflow paths within the structure or enclosure to each have at least one exit vent.

12. The method according to claim 1 wherein step (d) further comprises the step of:

designing the two separate airflow paths to have a length and a shape to achieve a worst harmonic possible in light of a shape of the structure or enclosure to prohibit the sound waves from propagating easily.

13. The method according to claim 1 further comprising the step of:

applying at least one surface coating to at least one surface within the structure or enclosure to add damping, thereby shifting the resonant frequency to one that is less offensive.

14. A structure or enclosure having increased audio entropy within the structure or enclosure and having diminished auditory perception outside the structure or enclosure, the structure or enclosure comprising:

a plurality of sound abating materials secured within the structure or enclosure;

a plurality of features secured within the structure or enclosure to redirect or trap sound waves;

a first airflow path and a second airflow path within the structure or enclosure that bounce the sound waves off the plurality of sound abating materials and the plurality of features, the first and second airflow paths each having at least one air directional change; and a plurality of intake and exhaust vent holes or openings having a placement, pattern, and size to create a shift in frequency of the sound waves to a non-audible or less offensive frequencies.

15. The structure or enclosure according to claim 14 wherein one of the plurality of sound abating materials is secured at each end of the two separate airflow paths within the structure or enclosure to prevent reflection of specific harmonics.

16. The structure or enclosure according to claim 14 further comprising:

at least one of a fiberglass board/mat material, a foam, and a textured neoprene secured to a duct walls of the two separate airflow paths within the structure or enclosure.

17. The structure or enclosure according to claim 14 wherein the size of the plurality of sound abating materials is determined based upon the frequencies that are desired to be diminished.

18. The structure or enclosure according to claim 14 wherein the plurality of sound abating materials is secured horizontally within the structure or enclosure staggered in height to refract waves by creating orthogonal steps.

19. The structure or enclosure according to claim 18 wherein a surfaces of the plurality of sound abating materials secured horizontally within the structure or enclosure staggered in height have reversed inclined planes to redirect the sound waves rearwards.

20. The structure or enclosure according to claim 18 wherein the plurality of sound abating materials secured horizontally within the structure or enclosure staggered in height is interleaved with different densities to create a resistance for the sound waves to travel through.

21. The structure or enclosure according to claim 14 wherein the plurality of features is selected from the group consisting of a plate, a tab, a tang, a helix, and a baffle, wherein the at least one feature redirects or traps the sound waves.

22. The structure or enclosure according to claim 14 further comprising:

a plurality of vanes in the first and second airflow paths of different lengths and spaced at unequal distances to attenuate different audio frequencies.

23. The structure or enclosure according to claim 14 further comprising:

at least one perforated sheet within the first and second airflow paths to redirect the sound waves as well as hold the plurality of sound abating materials in position within the first and second airflow paths.

24. The structure or enclosure according to claim 14 further comprising:

at least one exit vent in each of the two separate airflow paths within the structure or enclosure.

25. The structure or enclosure according to claim 14 wherein the first and second airflow paths have a length and a shape to achieve a worst harmonic possible in light of a shape of the structure or enclosure to prohibit the sound waves from propagating easily.

26. The structure or enclosure according to claim 14 further comprising:

at least one surface coating applied to at least one surface within the structure or enclosure to add damping, thereby shifting the resonant frequency to one that is less offensive.

27. A method for increasing audio entropy within a structure or enclosure to diminish auditory perception outside the structure or enclosure, the method comprising:

(a) securing a plurality of sound abating materials having different thicknesses, shapes, densities, and porosities within the structure or enclosure that absorb and dissipate an available sound energy;

(b) securing at least one feature within the structure or enclosure to redirect or trap sound waves;

(c) designing an airflow path within the structure or enclosure that bounces the sound waves off the plurality of sound abating materials and the at least one feature;

(d) designing the airflow path within the structure or enclosure to have at least two air directional changes that are in opposite directions to each other; and (e) designing the placement, pattern, and size of a plurality of intake vent and exhaust vent holes or openings to create a shift in frequency of the sound waves to a non-audible or less offensive frequencies.

28. The method according to claim 27 wherein step (d) further comprises the step of:

designing at least two separate air flow paths within the structure or enclosure.

29. A structure or enclosure having increased audio entropy within the structure or enclosure and having diminished auditory perception outside the structure or enclosure, the structure or enclosure comprising:

a plurality of sound abating materials having different thicknesses, shapes, densities, and porosities secured within the structure or enclosure that absorb and dissipate an available sound energy;

at least one feature secured within the structure or enclosure to redirect or trap sound waves;

an airflow path within the structure or enclosure that bounces the sound waves off the to plurality of sound abating materials and the at least one feature, the airflow path having at least two air directional changes that are in opposite directions to each other; and a plurality of intake and exhaust vent holes having a placement, pattern, and size to create a shift in frequency of the sound waves to a non-audible or less offensive frequencies.

30. The structure or enclosure according to claim 29 wherein the airflow path is comprised of a first air flow path and a second airflow path separate from the first air flow path.

* * * * *